US005388952A

United States Patent [19]

Hofele et al.

[11] Patent Number: 5,388,952

[45] Date of Patent: Feb. 14, 1995

[54] ARRANGEMENT FOR TRANSFERRING SHEET METAL PARTS IN A PRESS INSTALLATION

[75] Inventors: Hans Hofele, Göppingen; Karl Thudium, Wäschenbeuren, both of Germany

[73] Assignee: L. Schuler GmbH, Germany

[21] Appl. No.: 137,881

[22] Filed: Oct. 18, 1993

Related U.S. Application Data

[63] Continuation of Ser. No. 834,773, Feb. 13, 1992, abandoned.

[30] Foreign Application Priority Data

Feb. 16, 1991 [DE] Germany ..... 4104810

[51] Int. Cl.[6] ..... B65G 65/02

[52] U.S. Cl. ..... 414/752; 72/405

[58] Field of Search ..... 414/733, 749, 752, 751; 198/375, 468.4, 468.5; 72/405, 361; 100/207

[56] References Cited

U.S. PATENT DOCUMENTS

| | | | |
|---|---|---|---|
| 1,959,512 | 5/1934 | Wall et al. | 414/752 X |
| 4,523,889 | 6/1985 | Orii | 414/752 |
| 4,625,540 | 12/1986 | Yamada et al. | 72/405 |
| 4,634,338 | 1/1987 | Tsuge et al. | 414/733 X |
| 4,648,786 | 3/1987 | Sakurai | 414/752 |
| 4,981,031 | 1/1991 | Schneider et al. | 72/405 |
| 4,995,505 | 2/1991 | Takahashi et al. | 72/405 X |
| 5,159,827 | 11/1992 | Shiraishi et al. | 72/405 |

FOREIGN PATENT DOCUMENTS

| | | |
|---|---|---|
| 3905073 | 8/1990 | Germany . |
| 4001590 | 8/1990 | Germany . |
| 63-273530 | 4/1987 | Japan . |
| 62-142431 | 8/1987 | Japan . |

*Primary Examiner*—Donald W. Underwood
*Attorney, Agent, or Firm*—Evenson, McKeown, Edwards & Lenahan

[57] ABSTRACT

An arrangement for transferring sheet metal parts in a press installation, in which the sheet metal parts must be rotated with respect to their position in the next working stage. In addition, a collision between the sheet metal part and the tool during the transfer movement is avoided. During the transfer movement, the sheet metal parts are held on one traverse respectively which, on the end side, is disposed in bearing devices to be rotatable about an axis of rotation, and can be rotatably acted upon by a servomotor, a pressure cylinder or similar adjusting devices, such as a cam, and movement transmission devices.

7 Claims, 3 Drawing Sheets

ARRANGEMENT FOR TRANSFERRING SHEET METAL PARTS IN A PRESS INSTALLATION

This is a continuation of application Ser. No. 07/834,773, filed Feb. 13, 1992, now abandoned.

The present invention relates to an arrangement for the transferring of sheet metal parts in press installations having traverses for holding sheet metal parts, these sheet metal parts extending transversely with respect to a transfer movement direction and which can be lifted and lowered and moved in the transfer movement direction and back.

In press installations of this type, intermediate depositing devices are entered into the idle stages in order to decrease the transfer step which is determined by the distance between working stages.

In the German Patent Document 40 01 590 A1, an intermediate depositing device was described by means of which the workpiece resting on it can be lifted and lowered, can be horizontally displaced and can be tilted in the conveying direction, as well as transversely to the conveying direction.

The first working stage of press installations, as well as possibly the second working stage, is a drawing stage. The continued working of a sheet metal part may require an oblique position of the sheet metal part in the lower tool part. On the one hand, because of the high number of strokes, the lift-out stroke cannot be selected to be arbitrarily large, and, on the other hand, it is necessary to freely guide lowered drawn surfaces, which are bent by means of deep-drawing, above the mold of the lower part or lower parts of the tool.

An object of the present invention is to provide the ability of turning a sheet metal part at least in the lift-out phase from a lower part of a tool and to then turn it in the depositing phase into the next lower part of a tool. In the opposite-direction phases, the corresponding resetting movement is to be carried out.

This and other objects are achieved by the present invention which provides an arrangement for the transferring of sheet metal parts in press installations having traverses for holding sheet metal parts, these sheet metal parts extending transversely with respect to a transfer movement direction and which can be lifted and lowered and moved in the transfer movement direction and back. At least one of the traverses has an end side rotatable about an axis of rotation disposed in pivot bearings and is rotatably acted upon by an adjusting device and at least one movement transmission device.

By means of the provided rotation of the traverse during the lift-out, transfer and charging movement, the stroke in the transfer movement on the whole can be reduced, or the manufacturing can take place with an increased drawing depth.

Other objects, advantages and novel features of the present invention will become apparent from the following detailed description of the invention when considered in conjunction with the accompanying drawings.

DETAILED DESCRIPTION OF THE DRAWINGS

Figure 1:
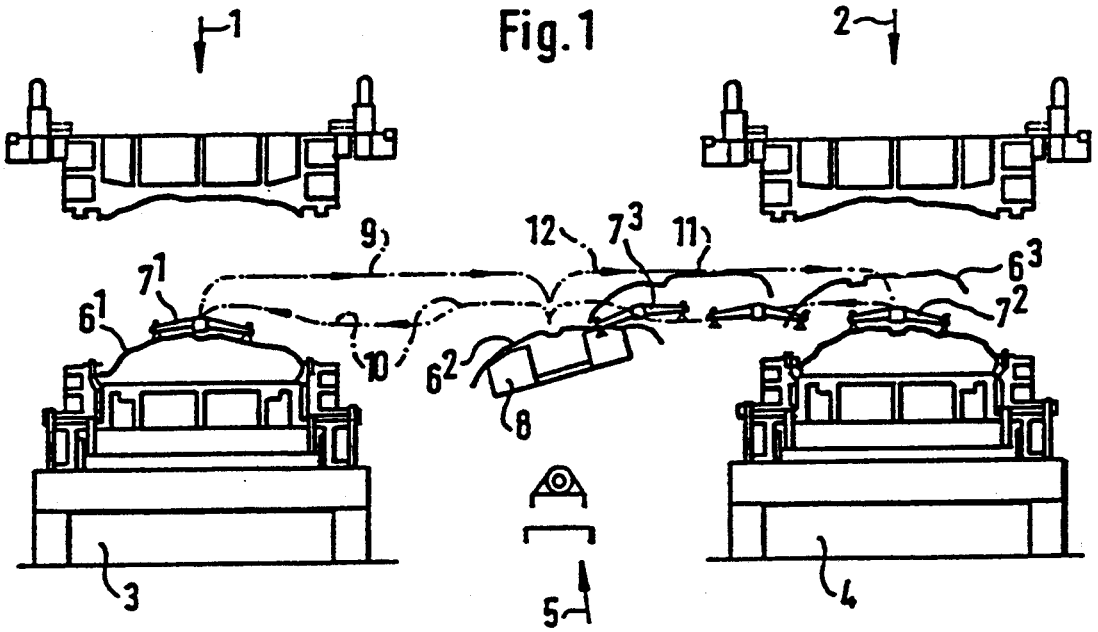
FIG. 1 is a view of the tool space of two working stages in a press installation.
Figure 2:
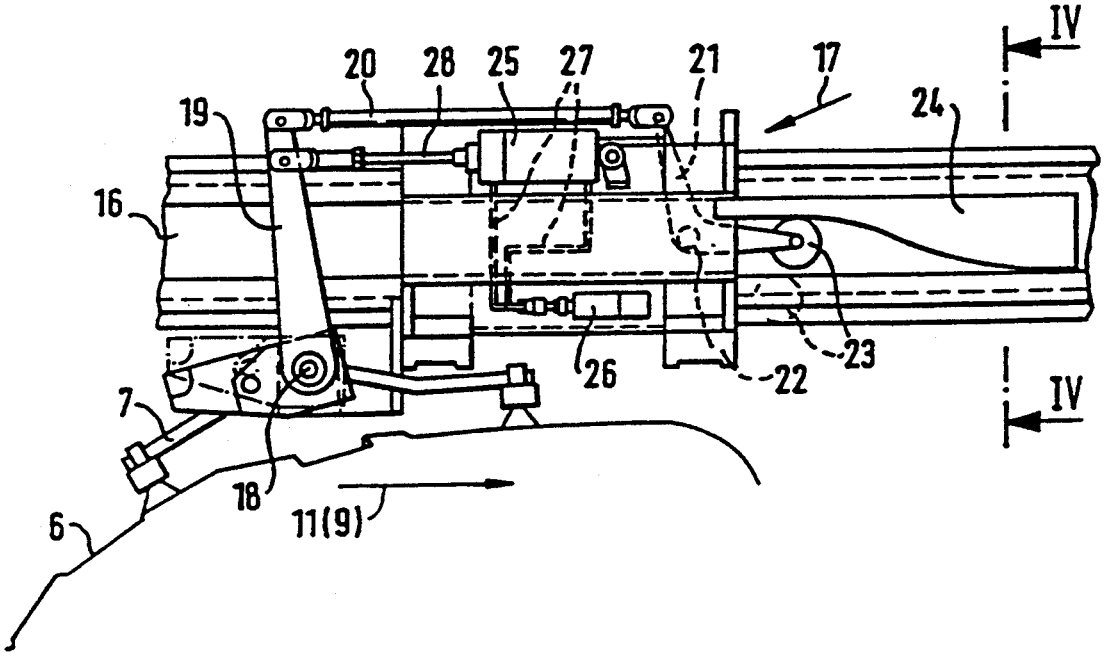
FIG. 2 is a frontal view of a moving carriage with a partial area of a moving rail.

In the working stages 1 and 2 of a press installation according to FIG. 1, tools are arranged with lower parts 3 and 4 of the tools. From these lower tool parts 3, 4, workpieces, here specifically sheet metal parts, can be removed, and sheet metal parts can be deposited in them. The lifting-out, depositing, and the transfer takes place by means of grippers, magnetic holders or suction devices which are fastened on traverses 7. The traverses 7 extend transversely to the transfer direction 9, 11 of the sheet metal parts 6, as illustrated in the other figures, while the projecting arms which form part of the traverse extend in the moving direction as seen in FIG. 2. In order to bridge the distances between the lower tool parts 3, 4, an intermediate depositing device 5 is arranged between the lower tool parts and has templates 8 for receiving one or two sheet metal parts $6^2$. The templates 8 may be adjustable in several axes in order to receive the sheet metal part during the depositing and to align it for the continued conveyance with respect to the height and the oblique position and with respect to the holding devices on the traverses.

The traverse $7^1$ transfers the sheet metal part $6^1$ of the first working stage in the transfer movement 9 to the intermediate depositing device 5. In this case, it may be necessary to turn the sheet metal part $6^1$ that is already in the lift-out movement from the lower tool part 3 into such a tilted position that, during the conveying movement along the horizontal line, the lower tool part 3 does not interfere with deep-drawn edges. The return movement of the traverse $7^1$ may take place corresponding to a resetting movement 10. The turning movement of the sheet metal part $6^1$ into a tilted position may take place as described with respect to FIGS. 2, 3 and 5. These figures relate to the turning of a sheet metal part $6^2$ and $6^3$ during a transfer movement 11 into the subsequent working stage 2.

The transfer movements 9 and 11 of the traverses $7^1$ and $7^2$ may take place synchronously and by the same paths. The traverse $7^2$ for the removal of the sheet metal part $6^2$ from the intermediate depositing device is shown here at the point in time of the depositing of the sheet metal part $6^1$ in the lower tool part 4. By means of the intermediate depositing device 5, the oblique position of the sheet metal part $6^2$ can be determined so that it can be moved without interference into the lower tool part 4. After the depositing of the sheet metal part $6^3$ in the lower tool part 4 and during the resetting movement 12, the traverse $7^2$ is rotated into a tilted position which corresponds to the tilted position of the sheet metal part in the intermediate depositing device 5.

The rotating adjustments of the traverses 7 which are indicated here are examples and may be achieved by means of a pivot bearing of the traverses 7 and the adjusting devices, as will be explained concerning the following figures. Accordingly, the invention also relates to those types of devices for the transfer of sheet metal parts in the case of which, differently from the shown arrangements in the figures, the traverses are fastened directly to the holding rails, and the holding rails carry out a horizontal and a vertical movement. Such a transfer device which can be used with the present invention is known, for example, from U.S. Pat. No. 4,625,540.

The transfer device illustrated in the figures improves on a transfer device described in U.S. Pat. No. 4,981,031 which corresponds to German Patent Document DE 39 05 073 A1. The transfer device shown here permits different moving sequences of the traverses. These are each fastened to two moving carriages which, being situated opposite one another, can be moved on moving rails which extend in parallel through the press installation. In this case, the moving rails carry out a vertical movement for the lifting-out and the depositing of the sheet metal parts. The transfer movement of the moving carriages takes place in a cam-controlled manner by way of driving linkages.

Figure 4:
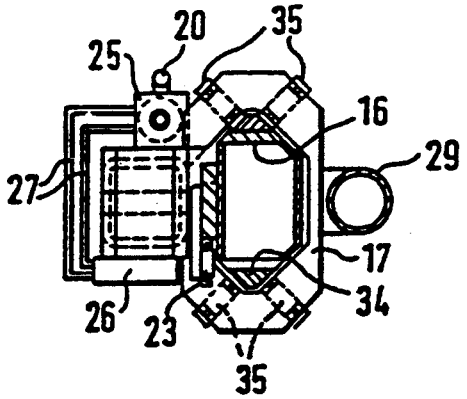
FIG. 4 is a lateral view (section IV—IV) from the right of the moving carriage shown in FIG. 2.
Figure 3:
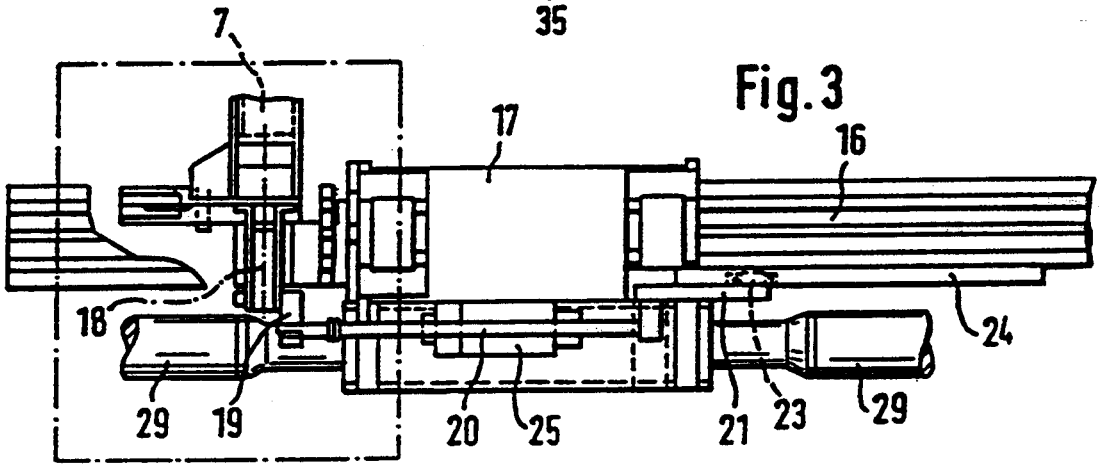
FIG. 3 is a top view of the moving carriage shown in FIG. 2.
Figure 5:
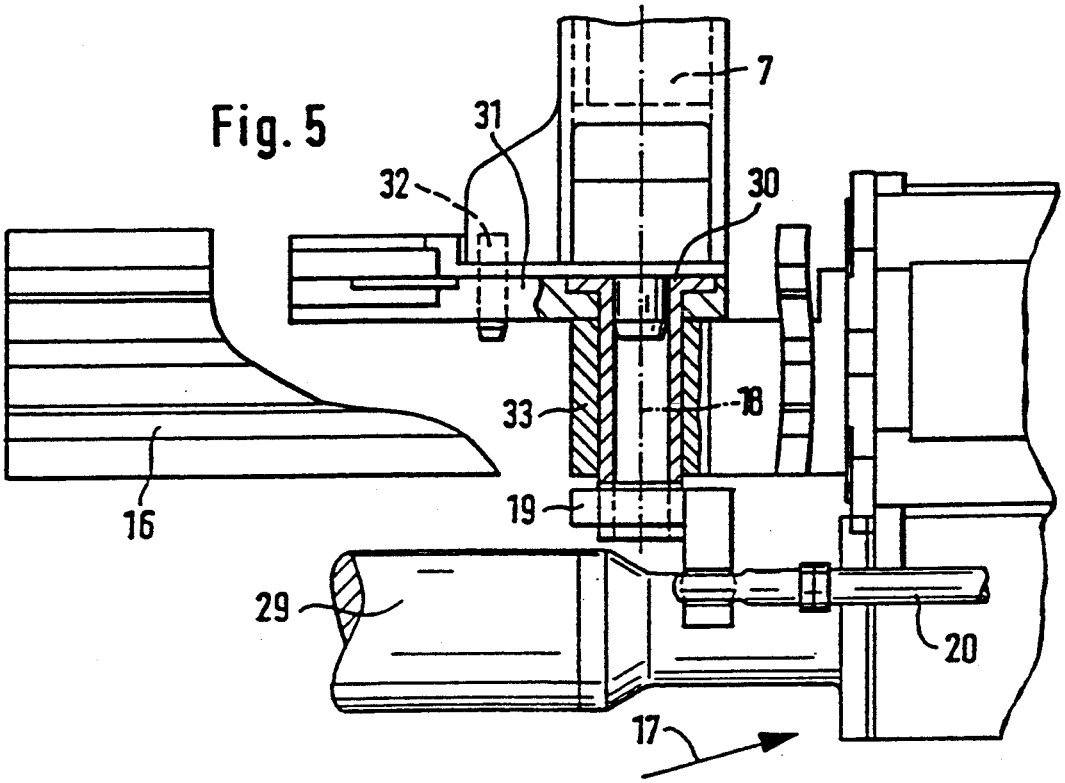
FIG. 5 is an enlargement of the area which is indicated by a dash-dotted line in FIG. 3.

FIGS. 2, 3 and 4 show one of two moving rails 16 on which one moving carriage 17 is disposed being longitudinally movable by way of runners 35. The moving drive takes place via a conveying linkage 29. A flanged bush 30 is rotatably inserted in a cast-on bearing 33 of the moving carriage 17 (FIG. 5). The flanged bush 30 is rigidly connected with a flange 31 by a flange neck. By means of one or several centering pins 32, the flange 31 interacts with an end area of the traverse 7 so that the flanged bush 30 and the traverse 7 represent a rigid structure at least during the movement operations.

On the other end of the flanged bush 31, a one-armed lever 19 is fastened which can be pivotally connected in two pivotal connecting areas, on the one hand, by a rod 20 and, on the other hand, by a rod 28. On the other end of the lever 19, the rod 20 is hinged to a two-armed rocker lever 21 which, by means of a cam follower roller 23, is placed against a cam 24 and is operatively engaged with it for a deflecting movement the cam 24 is fastened to one of the moving rails 16.

The rod 28 is connected with an adjusting device 25, such as a pressure cylinder. By means of the valve 26, the pressure cylinder 25 can be acted upon in at least two positions via pressure lines 27, in which case, in the first position, the cam follower roller 23 is held on the cam 24. By switching of the valve 26, the cam follower roller 23 can be held in a position where it is lifted off the cam 24. The resting of the cam follower roller 23 on the cam 24 is provided for the resetting movement of the traverse $7^3$ from the working stage 3 into the intermediate depositing device 5. As shown in FIG. 1, a rotation of the traverse 7 and of the holding devices mounted on it into a tilted or turned position corresponding to the templates 8 takes place in the intermediate depositing device 5. For the transfer movement 9 in which, for example, during the lift-out phase of the sheet metal part $6^1$ from the lower tool part 3, a rotating of the sheet metal part $6^1$ is to be provided, a correspondingly designed cam can be used so that a second representation with a description corresponding to FIG. 2 is not necessary to one of ordinary skill in the art. The course of the cam, the stroke of the cam follower roller 23 along the path on the cam as well as the switching of the valve cause rotating movements of the traverse 7 about its axis of rotation 18 and thus a guided tilting movement of the holding devices for the sheet metal parts 6.

In addition, FIG. 4 shows the profile of the moving carriage 17 which via runners 35 is disposed on moving strips 34 which are inserted into the moving rails 16. For a direct fastening of the traverses 7 on liftable and lowerable rails, which can be adjusted in the transfer direction, instead of the illustrated moving rails, it would be necessary to arrange the cams 24 fixedly on the press frame. Another embodiment of the invention provides an individual adjusting device, such as a servomotor or a hydraulic cylinder for each traverse on the rail for the triggering of the rotating/tilting position of the traverse rotatably disposed in the rail. For the reduction of forces and torques, the arrangement of twice the number of cams according to FIG. 2 or of adjusting devices is conceivable with a direct fastening of the traverse on the rails.

Figure 6:
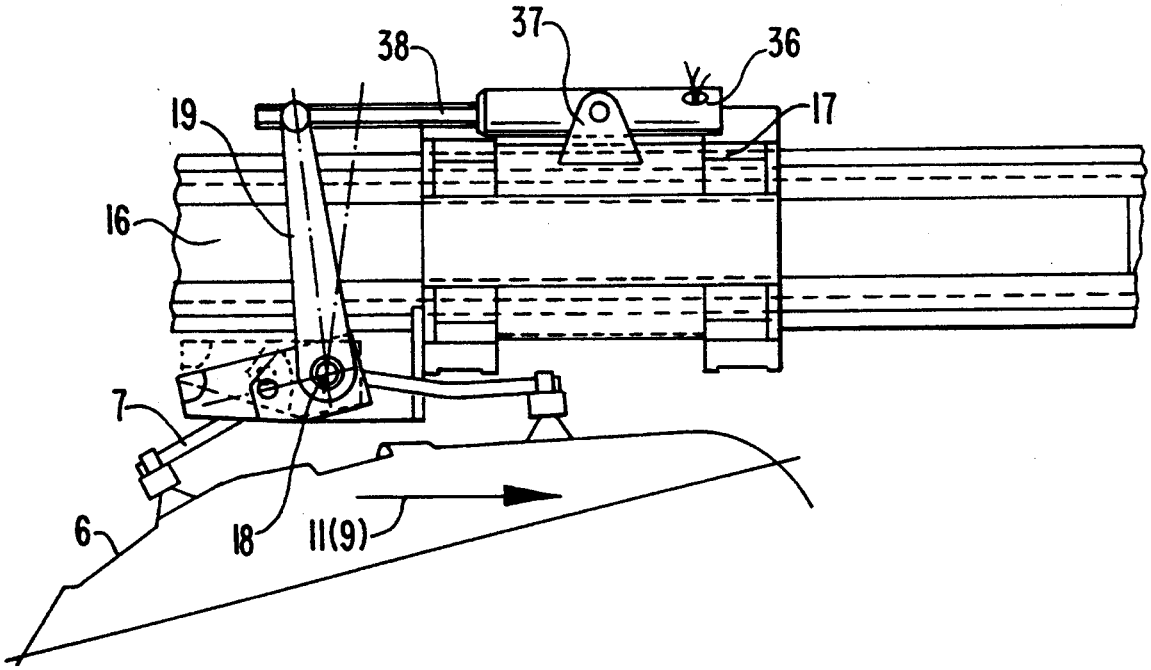
FIG. 6 is a front view of a moving carriage corresponding to FIG. 2, but using a servomotor.
Figure 7:
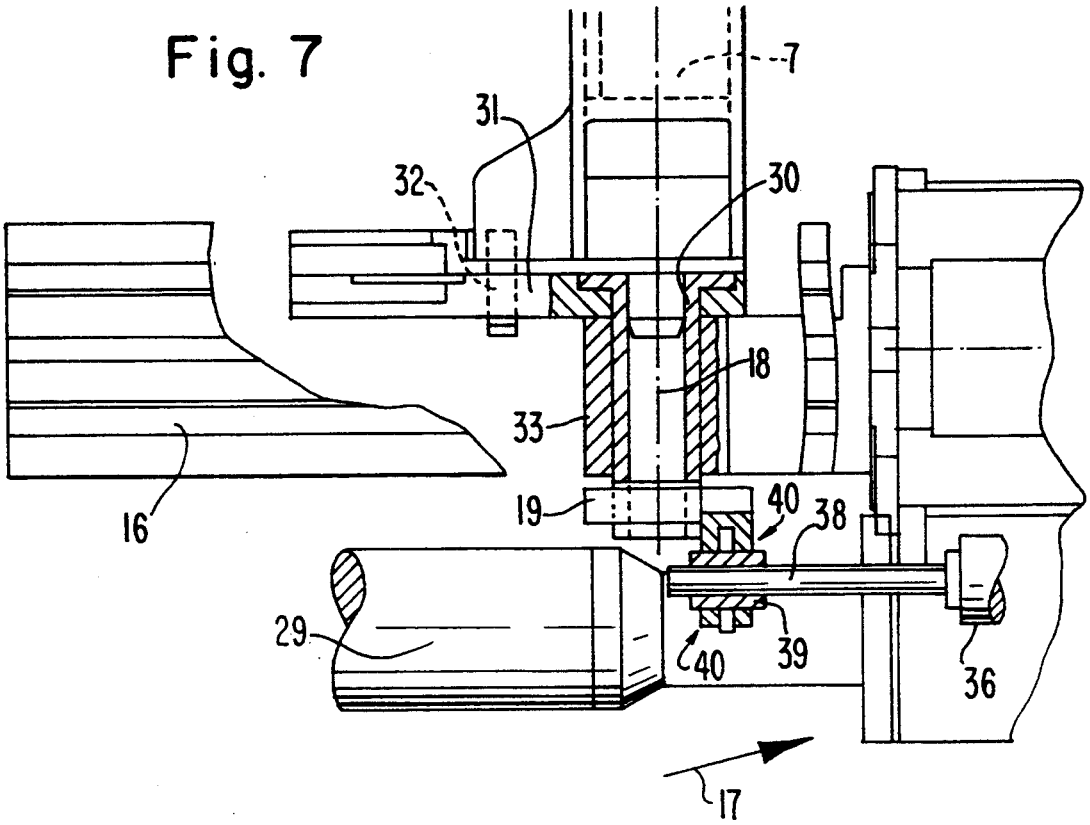
FIG. 7 is a top view of the forward area of the embodiment of the moving carriage illustrated in FIG. 6 together with the movement transmission devices.

Analogously to FIGS. 2 and 5, which show a cam control for the rotation of the traverse 7, FIGS. 6 and 7 show an embodiment with a servomotor 36 for the rotation of the traverse 7. The servomotor 36 is pivotally disposed on the moving carriage 17 in holding brackets 37. The servomotor 36 may be a torque motor which can be acted upon electrically and, via its motor shaft, lengthened as a threaded spindle 38, engages in a nut 39 and interacts with it. As shown particularly in FIG. 7, the nut 39 is held pivotally in pivot bearings 40 on a one-armed lever 19 for the traverse 7. The oblique position of the traverse 7 may therefore, in contrast to the forced control by means of the cam control in FIGS. 2, 3 and 5, take place in a freely programmable manner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. In an arrangement for the transfer of a sheet metal part within a press installation that has traverses comprising gripper means for holding sheet metal parts, said traverses extending transversely with respect to a transfer movement direction and which can be lifted and lowered and moved in the transfer movement direction and back, carriages movable on moving rails and which are liftable and lowerable with said rails, the improvement comprising:

pivot bearings in which opposite ends of at least one of the traverses are rotatably disposed about an axis of rotation, each of the traverses being disposed between a pair of the moving carriages;

an adjusting device mounted on one of said carriages; and at least one movement transmission device coupled between the adjusting device and one of the ends of said at least one of the traverses, the adjusting device rotatably adjusting the one end of the traverse and thus the gripper means around said axis of rotation to different angular orientations via the movement transmission device.

2. In an arrangement for the transfer of a sheet metal part within a press installation that has traverses comprising gripper means for holding sheet metal parts, said traverses extending transversely with respect to a transfer movement direction and which can be lifted and lowered and moved in the transfer movement direction and back, carriages movable on moving rails and which are liftable and lowerable with said rails, the improvement comprising:

pivot bearings in which opposite ends of at least one of the traverses are rotatably disposed about an axis of rotation, each of the traverses being disposed between a pair of the moving carriages;

an adjusting device mounted on one of said carriages;

at least one movement transmission device coupled between the adjusting device and one of the ends of said at least one of the traverses, the adjusting device rotatably adjusting the end of the traverse and thus the gripper means around said axis of rotation to different angular orientations via the movement transmission device;

the transmission device comprising at least one first lever that is pivotally mounted on one of the moving carriages and is coupled to the one end of the traverse;

a rod coupled to the first lever;

the adjusting device comprising an angle lever with a cam follower roller, the angle lever being coupled to the rod; and a cam which is fastened to one of said rails which is assigned to the moving carriage, the cam follower roller being in operative engagement with the cam.

3. An arrangement according to claim 2, wherein the cam follower roller, by means of said adjusting device, is fastened on the moving carriage operatively engageable with the cam and is liftable off the cam by switching of the adjusting device.

4. The arrangement of claim 1, wherein the adjusting device is a servomotor.

5. The arrangement of claim 1, wherein the adjusting device is a pressure cylinder.

6. The arrangement of claim 1, wherein the adjusting device is a cam control.

7. An arrangement according to claim 1, wherein the movement transmission device includes at least one first lever that is pivotally arranged on at least one of each pair of moving carriages and is coupled to the end of the traverse attached between said each pair of carriages and is also coupled to the adjusting device; a rod coupled to the first lever; an angle lever with a cam follower roller, the angle lever being coupled to the rod; and a cam fastened to one of said rails which is assigned to the moving carriage and is in operative engagement with the cam follower roller.

* * * * *